United States Patent [19]

Wilson

[11] 4,315,415

[45] Feb. 16, 1982

[54] PLENUM TYPE VARIABLE AIR VOLUME MOUNTING CURB

[75] Inventor: Roy J. Wilson, Tulsa, Okla.

[73] Assignee: John Zink Company, Tulsa, Okla.

[21] Appl. No.: 68,487

[22] Filed: Aug. 21, 1979

[51] Int. Cl.[3] ..... F25D 23/00

[52] U.S. Cl. ..... 62/263; 137/527.8; 62/DIG. 16

[58] Field of Search ..... 62/DIG. 16, 263; 417/307; 137/527.8; 251/303; 49/387

[56] References Cited

U.S. PATENT DOCUMENTS

| | | | |
|---|---|---|---|
| 403,830 | 5/1889 | Flood | 137/527.8 X |
| 2,401,392 | 2/1949 | Parry | 137/527.8 |
| 3,398,551 | 8/1968 | Yannascoli | 417/307 X |
| 3,723,025 | 3/1973 | Coakley | 417/307 X |
| 3,833,316 | 9/1974 | Kemper | 417/307 |
| 4,118,083 | 10/1978 | Lackey et al. | 62/DIG. 16 X |

*Primary Examiner*—William E. Tapolcai, Jr.
*Attorney, Agent, or Firm*—Head & Johnson

[57] ABSTRACT

An air conditioning unit mounting curb adapted for flat roof-top mounting with provisions for ducts for passage of air to and from an air conditioning unit from and to a plurality of rooms immediately subadjacent and spaced below the roof top. The mounting curb is comprised of a rectangular outer perimeter, a closed bottom, a wall dividing the curb into two plenums, and at least one opening in one of the plenums for supply of air to the rooms and at least one opening in the second plenum for return air from said rooms. The improvement in the mounting curb comprises a bypass means between the plenums, which is responsive to pressure differential acting thereon, providing a variable air volume system. The bypass means consists of an opening in the dividing wall, a damper blade covering the opening and hingeably connected to the return air side of the dividing wall, a lever attached at one end to the damper blade and at the opposite end thereof to an axle rod, which extends through the curb. An adjustable counterweight is provided on the end of the rod to yieldably maintain the damper blade in the closed position.

2 Claims, 3 Drawing Figures

PLENUM TYPE VARIABLE AIR VOLUME MOUNTING CURB

BACKGROUND OF THE INVENTION

1. Field of the Invention

The present invention relates to a roof-top mounting curb for air conditioning systems and, more particularly, to such a curb which is of a plenum design and is provided with variable air volume means.

2. Description of the Prior Art

Air conditioning systems as used for multiroomed buildings are usually of a constant air volume design. As each room within the building reaches a satisfactory temperature, as set by a thermostat, dampers within the supply air ducts are automatically closed. The closing of these dampers increases the back pressure within the air conditioning systems, thereby increasing the load upon the air conditioning components, which wastes electricity and possibly damages the components within the air conditioning unit. Various methods have been used to vary the air volume of the air conditioning systems as the rooms reach a satisfactory temperature. One prior art method utilizes variable bladed inlet vanes mounted to a blower within the air conditioning unit whereby the pitch of the vane blades within the blower decreases with the increase of back pressure within the air conditioning system. This type of blower is expensive to install and maintain and is not compatible with smaller, 5 to 15-ton, air conditioning systems. Another prior art method utilizes a bypass duct, spaced within the building's attic or walls, for passing a portion of supply air directly to the return air as the back pressure within the air conditioning system increases. This method requires extra duct work to be installed within the building, thereby increasing the cost of construction of the building and offers limited access to the bypass duct mechanism in the event of failure.

None of these prior art methods have provided a variable air volume system in combination with the plenum type toof-top mounting curb.

SUMMARY OF THE INVENTION

The present invention provides a means for adjusting the air volume to rooms as each room temperature is satisfied. The invention is of an air conditioning unit mounting curb which is adapted for flat roof-top mounting, with provisions for ducts for passage of air to and from an air conditioning unit from and to a plurality of rooms immediately subadjacent and spaced below the roof top. The mounting curb is comprised of a rectangular outer perimeter, a closed bottom, a wall dividing the curb into two plenums, and at least one opening in one of the plenums for supply of air to the rooms and at least one opening in the second plenum for return air from said rooms. The improvement in the mounting curb, comprises a bypass means between the plenums, which is responsive to pressure differential acting thereon, providing a variable air volume system. The bypass means consists of an opening in the dividing wall, a damper blade covering the opening and hingeably connected to the return air side of the dividing wall, a lever attached at one end to the damper blade and at the opposite end to an axle rod, which extends through the curb. An adjustable counter-weight is provided on the end of the rod to yieldably maintain the damper blade in the closed position.

DETAILED DESCRIPTION OF THE PREFERRED EMBODIMENT

Figure 1:
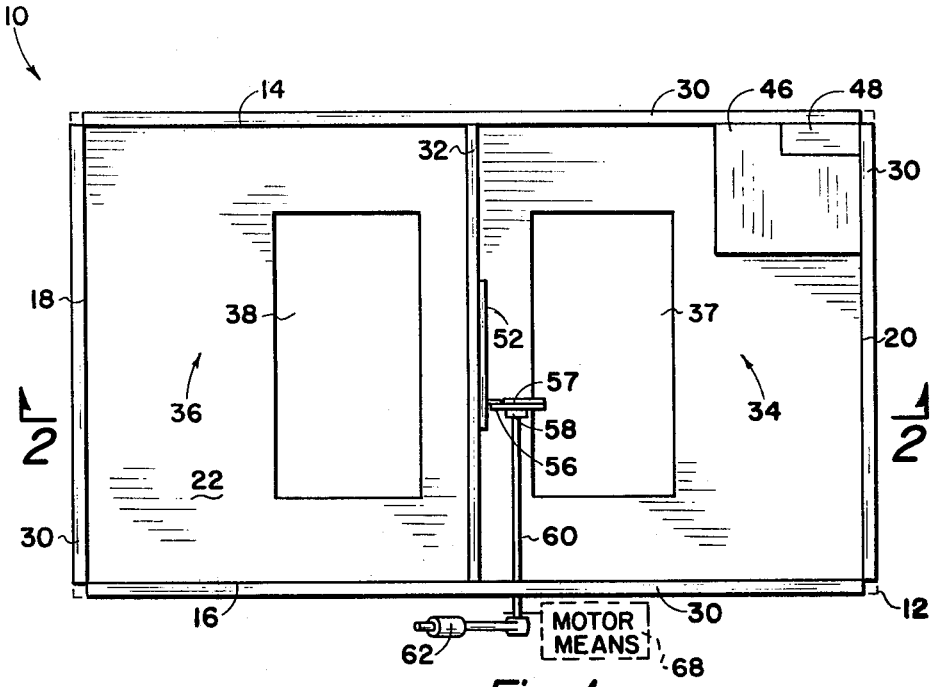
FIG. 1 is a top plan view of the plenum-type variable air volume mounting curb embodying the present invention.
Figure 2:
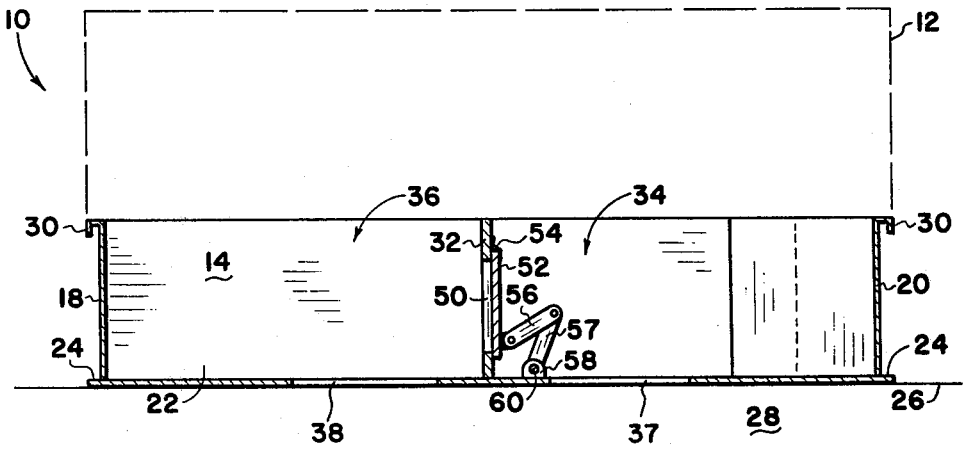
FIG. 2 is a side view of FIG. 1 taken along line 2—2.

Referring to the drawings in detail, reference character 10 generally indicates a plenum-type variable air volume roof-top mounting curb. As shown in FIGS. 1 and 2, an air conditioning unit 12 (as shown by dotted lines), which can comprise a refrigerating and heating apparatus, as well-known in the art, is mounted upon the curb 10. The curb 10 is substantially rectangular in shape and is composed of a shallow metal pan or box with side walls 14 and 16, end walls 18 and 20, and a bottom member 22, attached each to another. The bottom edges of the side walls 14 and 16 and the end walls 18 and 20, are provided with outwardly extending flanges 24, whereby the curb 11 may be fastened to a roof deck 26 of a building 28 in any suitably conventional manner. The top edges of the side walls 14 and 16 and the end walls 18 and 20 are provided with outwardly extending lips 30, whereby the air conditioning unit 12 is fastened thereto in any suitable conventional manner.

Figure 3:
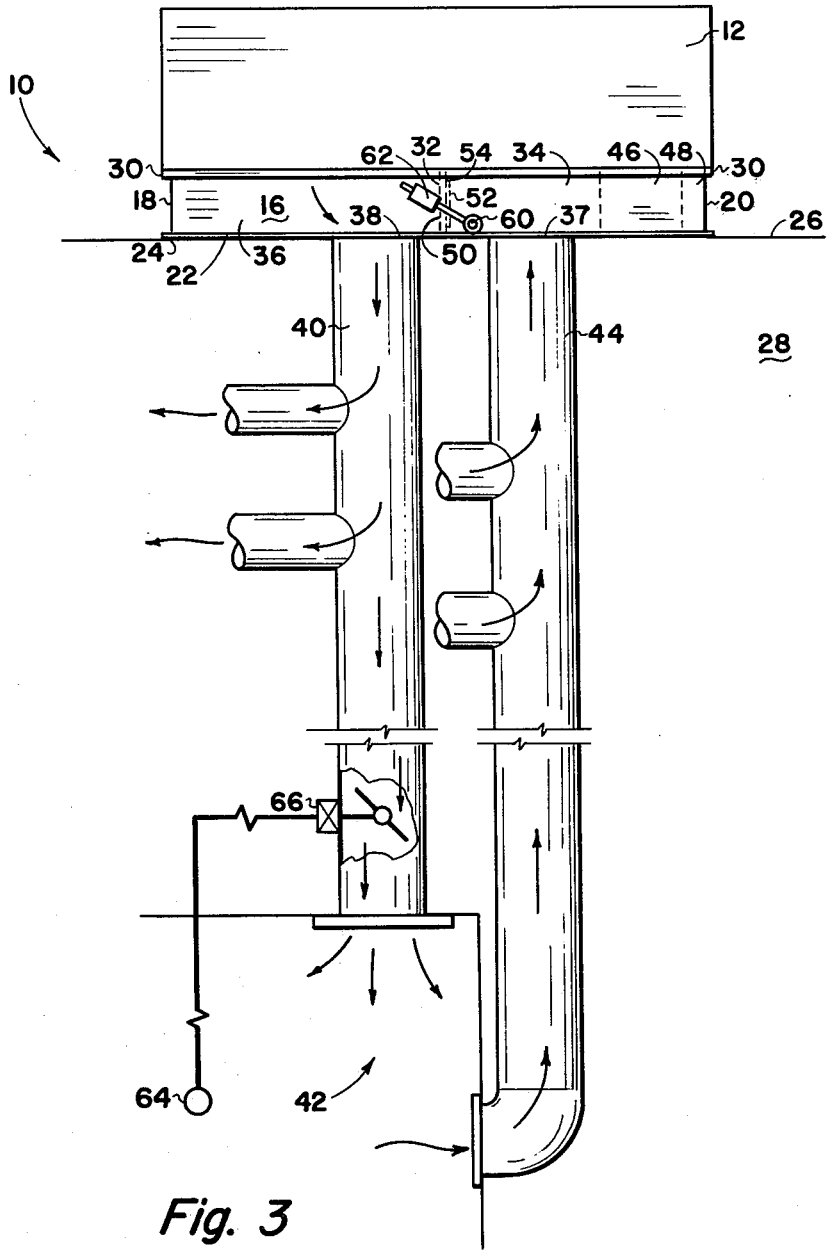
FIG. 3 is a semi-diagrammatic view of a building air conditioning system, with the present invention included therein.

The curb 10 is divided by a wall 32 into two plenums, one plenum 34, and another plenum 36. Respective rectangular openings 37 and 38 are spaced within the base 22 of each of the plenums 34 and 36 adjacent the wall 32 and equal distance from the side walls 14 and 16. As best shown in FIG. 3, conditioned air from the air conditioning unit 12 flows through the opening 38 in the plenum 36 into a duct 40, which carries the conditioned air to a plurality of rooms 42 immediately subadjacent and spaced below the roof top 26. Return air is drawn from the rooms 42 by the air conditioning unit 12, through a duct 44, which is attached to the opening 37 in the plenum 34.

A rectangular support housing 46 is spaced within the plenum 34, adjacent to the corner of the side wall 14 and the end wall 20. The housing 46 provides support and noise retinuation for a compressor (not shown) within the air conditioning unit 12. An opening 48 within the top of the housing 46 provides access for electrical power from within the building 28 to the air conditioning unit 12.

A rectangular opening 50 is centrally spaced within the wall 32 and is yieldably covered by the damper blade 52, which is hingeably attached at the top thereof to the plenum 34 side of the wall 32 by means of an elongated or piano hinge 54. A lever 56 is centrally pivotally attached at one end thereof to the damper blade 52 adjacent to the side wall 16 and pivotally connected to a lever 57 at the opposite end thereof. The lever 57 is attached between vertical parallel lugs 58 which are attached to the bottom member 52. One end of an elongated axle rod 60 passes through the lever 57 and parallel lugs 58 and is secured thereto by a thumb screw (not shown). The axle rod 60 passes parallel to the wall 32 through the side wall 16, where an adjustable counterweight 62 is attached to the opposite end thereof.

In operation, conditioned air flows from the air conditioning unit 12 through the duct 40 into the rooms 42. Each room 42 is provided with a thermostat 64, which is in communication with a damper means 66 within the duct 40, and adjacent the room 42. As the temperature within the room 42 is satisfied, the damper 66 will automatically close, thereby stopping the supply of conditioned air into the room 42. When the damper 66 closes, the back pressure within the air conditioning unit 12 and supply air plenum 16 increases. This increase of back pressure puts an increased load upon the components of the air conditioning unit 12, thereby increasing its usage of electricity and possibly damaging the components. This back pressure overcomes the weight of the counterweight 62 to force the bypass damper 52, bypasses a portion of the conditioned air into the return air supply and the back pressure is reduced. As more rooms 42 are satisfied, the respective dampers 66 close, which increases the back pressure and forces the bypass damper 52 to open fully. Optionally, a motorized operator means 68, as shown in FIG. 1, in communication with an air pressure measuring means (not shown) within the air conditioner 12, may be attached to the axle rod 60 to mechanically open and close the damper blade 52.

Whereas the present invention has been described in particular relation to the drawings attached hereto, it should be understood that other and further modifications of the invention, apart from those shown or suggested herein, may be made within the scope and spirit of this invention.

What is claimed is:

1. In an air conditioning unit mounting curb with provisions for ducts for passage of air to and from an air conditioning unit from and to a plurality of rooms immediately subadjacent, comprised of a rectangular outer perimeter, a closed bottom, a wall dividing said curb into two plenums, at least one opening in one of said plenums for supply of air to said rooms, and at least one opening in a second of said plenums for return air from said rooms, the improvement comprising a normally closed bypass means between said plenums, said bypass means comprising an opening in said dividing wall, a damper blade covering said opening and hingeably connected to the return air side of said dividing wall, means to yieldably maintain said damper blade normally closed until a given pressure differential is established, comprising a lever means pivotally connected at one end to said damper blade and at an opposite end to an adjustable counter-weight, and means to open said by pass means, responsive to said given pressure differential acting thereupon, and thus provide a variable air volume system to said rooms.

2. In an air conditioning unit mounting curb with provision for ducts for passage of air to and from an air conditioning unit from and to a plurality of rooms immediately subadjacent, comprised of a rectangular outer perimeter, a closed bottom, a wall dividing said curb into two plenums, at least one opening in one of said plenums for supply of air to said rooms, and at least one opening in a second of said plenums for return air from said rooms, the improvement comprising a normally closed bypass means between said plenums, said bypass means comprising an opening in said dividing wall, a damper blade covering said opening and hingeably connected to the return air side of said dividing wall, means to yieldably maintain said damper blade normally closed until a given pressure differential is established, comprising a hinge connecting the top edge of said damper blade to said return air side of said dividing wall, a first lever being pivotally connected at one end adjacent the lower portion of said damper blade, a second lever pivotally connected at one end to an opposite end of said first lever and an opposite end of said second lever pivotally connected between a plurality of parallel lugs, connected to said bottom of said return air plenum by a first end of an axle rod passing therethrough, an opposite end of said axle rod extending outwardly parallel to said dividing wall through said outer perimeter, and an adjustable counter-weight attached to said opposite end of said axle rod, means to open said bypass means, responsive to said given pressure differential acting thereupon, and thus provide a variable air volume system to said rooms.

* * * * *